US009133812B2

(12) United States Patent
Kameda

(10) Patent No.: US 9,133,812 B2
(45) Date of Patent: Sep. 15, 2015

(54) IGNITION APPARATUS AND IGNITION SYSTEM

(75) Inventor: Hiroyuki Kameda, Nagakute (JP)

(73) Assignee: NGK Spark Plug Co., Ltd., Aichi (JP)

( * ) Notice: Subject to any disclaimer, the term of this patent is extended or adjusted under 35 U.S.C. 154(b) by 441 days.

(21) Appl. No.: 13/699,113

(22) PCT Filed: Dec. 26, 2011

(86) PCT No.: PCT/JP2011/007252

§ 371 (c)(1),
(2), (4) Date: Nov. 20, 2012

(87) PCT Pub. No.: WO2012/093461

PCT Pub. Date: Jul. 12, 2012

(65) Prior Publication Data

US 2013/0269643 A1 Oct. 17, 2013

(30) Foreign Application Priority Data

Jan. 4, 2011 (JP) ..... 2011-000022
Apr. 4, 2011 (JP) ..... 2011-082366
Apr. 18, 2011 (JP) ..... 2011-019646

(51) Int. Cl.

| | |
|---|---|
| ***F02P 3/01*** | (2006.01) |
| ***F02P 15/00*** | (2006.01) |
| *F02P 3/04* | (2006.01) |
| *F02P 3/08* | (2006.01) |

(52) U.S. Cl.
CPC . *F02P 15/00* (2013.01); *F02P 3/01* (2013.01); *F02P 3/04* (2013.01); *F02P 3/08* (2013.01)

(58) Field of Classification Search
CPC ..... F02P 15/00; F02P 3/01; F02P 3/04; F02P 3/08
See application file for complete search history.

(56) References Cited

U.S. PATENT DOCUMENTS

| | | | | |
|---|---|---|---|---|
| 7,387,115 | B1 * | 6/2008 | Katoh et al. | 123/620 |
| 8,082,897 | B2 * | 12/2011 | Kato et al. | 123/169 EL |
| 8,847,494 | B2 * | 9/2014 | Kameda et al. | 315/111.21 |
| 2007/0114901 | A1 * | 5/2007 | Nagasawa et al. | 313/141 |
| 2007/0221156 | A1 * | 9/2007 | Hagiwara et al. | 123/143 B |
| 2007/0221157 | A1 * | 9/2007 | Hagiwara et al. | 123/143 B |
| 2009/0007893 | A1 * | 1/2009 | Kato et al. | 123/596 |
| 2010/0132666 | A1 * | 6/2010 | Sato et al. | 123/406.19 |
| 2011/0297131 | A1 * | 12/2011 | Nakano et al. | 123/596 |

FOREIGN PATENT DOCUMENTS

| | | | |
|---|---|---|---|
| JP | 55-007952 | 1/1980 | F02P 3/01 |
| JP | 2010-218768 | 9/2010 | F02P 3/01 |
| WO | WO 2010/095694 | 8/2010 | H01T 13/54 |

OTHER PUBLICATIONS

International Search Report for International Application No. PCT/JP2011/007252, Apr. 17, 2012.

* cited by examiner

*Primary Examiner* — Hieu T Vo
*Assistant Examiner* — Sherman Manley
(74) *Attorney, Agent, or Firm* — Kusner & Jaffe

(57) ABSTRACT

An ignition apparatus which facilitates improvement in energy efficiency as well as materializing an excellent ignitability through effectively utilizing energy used for inductive discharge as a blowout power. The ignition apparatus is used for an ignition plug that includes a center electrode, a ground electrode and a cavity surrounding at least a portion of a clearance formed between the two electrodes to thereby form a discharge space. The ignition apparatus includes a voltage application portion which applies voltage to the clearance and a power supply portion which supplies electric power to the clearance. In addition, a capacitance portion for storing a capacitance is provided, in parallel with the ignition plug, in a voltage application path of the voltage application portion.

5 Claims, 5 Drawing Sheets

IGNITION APPARATUS AND IGNITION SYSTEM

FIELD OF THE INVENTION

The present invention relates to an ignition apparatus for a plasma jet ignition plug which ignites an air-fuel mixture through formation of plasma.

BACKGROUND OF THE INVENTION

Conventionally, a combustion apparatus, such as an internal-combustion engine, uses a spark plug for igniting an air-fuel mixture through spark discharge. In recent years, in order to meet demand for high output and low fuel consumption, a plasma jet ignition plug has been proposed, because the plasma jet ignition plug provides quick propagation of combustion and can more reliably igniting even a lean air-fuel mixture having a higher ignition-limit-air fuel ratio.

Generally, the plasma jet ignition plug includes a cylindrical insulator having therein an axial bore, a center electrode inserted into the axial bore in such a manner that a front end surface thereof is located internally of a front end surface of the insulator, a metallic shell disposed externally of the outer circumference of the insulator, and an annular ground electrode joined to a front end portion of the metallic shell. Also, the plasma jet ignition plug has a space (cavity) defined by the front end surface of the center electrode and an inner circumferential surface of the axial bore. The cavity communicates with an ambient atmosphere via a through hole formed in the ground electrode.

Additionally, such a plasma jet ignition plug ignites an air-fuel mixture as follows. First, voltage is applied to a cavity formed between the center electrode and the ground electrode, thereby generating spark discharge therebetween and thus causing dielectric breakdown therebetween. In this condition, electrical energy is applied to the cavity so that a gas in the cavity becomes a plasma state and plasma is generated within the cavity. The generated plasma is discharged or jetted through an opening of the cavity, thereby igniting the air-fuel mixture.

Meanwhile, a known ignition apparatus for a plasma jet ignition plug includes: a voltage application portion for applying voltage to the cavity and causing spark discharge; and a power supply portion for supplying electric power energy to the cavity (e.g., refer to Japanese Patent Application Laid-Open (kokai) No. 2010-218768 "Patent Document 1").

SUMMARY OF THE INVENTION

Problems to be Solved by the Invention

In order to realize excellent ignitability, plasma or an initial flame kernel generated by an ignition of an air-fuel mixture with plasma is required to have a certain blowout power towards outside of the cavity (i.e., towards the center of a combustion chamber). Technique disclosed in Patent Document 1 acquires such blowout power through electric power energy supplied from a power supply portion. However, this technique requires substantially large energy to generate sufficient blowout power.

Further, according to the technique disclosed in Patent Document 1, when spark discharge is caused by an application of voltage, an inductive discharge where minute current continues to flow is caused after capacitive discharge where voltage drastically changes. Although the capacitive discharge stimulates a gas to change into plasma and also contributes to improvement in ignitability, the inductive discharge hardly contributes to improvement in ignitability. That is, energy for the inductive discharge is wasted, and energy efficiency tends to deteriorate.

The present invention has been conceived in view of the above circumstances, and an object of the invention is to provide an ignition apparatus and an ignition system both of which facilitates improvement in energy efficiency as well as materializing an excellent ignitability through effectively utilizing energy for inductive discharge as a blowout power.

Means for Solving the Problems

Configurations suitable for achieving the above object will next be described in itemized form. If needed, actions and effects peculiar to the configurations will be described additionally.

Configuration 1

An ignition apparatus used for a plasma jet ignition plug which includes a center electrode, a ground electrode, and a cavity which surrounds at least a portion of a clearance formed between the two electrodes to thereby form a discharge gap, the ignition apparatus comprising:

a voltage application portion which applies voltage to the clearance; and a power supply portion which supplies electric power to the clearance, wherein a capacitance portion for storing capacitance is provided, in parallel with the plasma jet ignition plug, in a voltage application path of the voltage application portion.

"The voltage application path of the voltage application portion" means a portion whose voltage can be equal to an output voltage from the voltage application portion due to an addition of the output voltage from the voltage application portion (e.g., a conduction path connecting the voltage application portion to an ignition plug).

Configuration 2

In Configuration 1, the ignition apparatus according to Configuration 2, wherein a capacitance of the capacitance portion is equal to or larger than that of the plasma jet ignition plug.

Configuration 3

In Composition 1 or 2, the ignition apparatus according to Configuration 3, wherein the capacitance of the capacitance portion falls within a range of 20 pF to 500 pF.

Configuration 4

An ignition system comprising: the ignition apparatus according to any one of Configurations 1 to 3; and a plasma jet ignition plug which is electrically connected to the voltage application portion and the power supply portion.

Configuration 5

In Configuration 4, the ignition system according to Configuration 5 wherein electric power energy supplied from the power supply portion is 100 mJ or less.

Effect of the Invention

According to the ignition apparatus of Configuration 1, the capacitance portion is provided, in parallel with the plasma jet ignition plug (hereinafter referred to as "ignition plug"), in the voltage application path of the voltage application portion. Therefore, when voltage is applied to the clearance from the voltage application portion, electric charge is stored in both ignition plug and capacitance portion. When the potential difference of the clearance exceeds the dielectric breakdown voltage of the clearance, electric charge stored in the capacitance portion flows into the clearance in addition to the electric charge stored in the ignition plug, thereby causing the capacitive discharge. Therefore, the current caused by the capacitive discharge can be increased, which leads to an improvement in plasma generation efficiency.

Since the resistance of the clearance decreases when the capacitive discharge is caused, the current flows into the clearance from the voltage application portion, which results in generation of the inductive discharge. According to the ignition apparatus of Configuration 1, the current from the voltage application portion flows into the capacitance portion and is charged therein. That is, the capacitance portion is charged by the energy conventionally used for inductive discharge. The capacitive discharge can be again generated by the electric charge stored in the capacitance portion and the electric charge stored in the ignition plug. The effect of the capacitive discharge (i.e., very quick voltage change) can generate a blowout power for plasma or an initial flame kernel. During the supply of electric power energy from the voltage application portion, the capacitance portion is charged, and the capacitive discharge can be repeatedly generated by the electric charge stored in the capacitance portion or the like. Thus, the blowout power is imparted to plasma or the initial flame kernel plural times. As a result, the large blowout power is imparted to plasma or the like, whereby excellent ignitability can be realized.

According to the ignition apparatus of Configuration 1, it is not necessary to supply excessive electric power energy from the power supply portion to the ignition plug in order to generate the blowout power. The electric power energy supplied from the power supply portion can be the minimum energy sufficient to generate plasma (i.e., to generate an ignitable heat source). Therefore, the electric power energy supplied from the power supply portion can be substantially reduced, whereby energy efficiency can be greatly improved.

The capacitive discharge normally continues only for a short time. However, if the capacitive discharge continues beyond the completion of the charge of the capacitance portion, the current flows into the clearance in which resistance thereof has decreased due to the capacitive discharge. As a result, the inductive discharge is likely to be generated.

According to the ignition apparatus of Configuration 2, since the capacitance of the capacitance portion is larger than that of the ignition plug, the electric charge which flows into the clearance after the capacitive discharge can be reduced, and the capacitive discharge easily ceases. Therefore, when the charge of the capacitance portion is completed and the current from the voltage application portion or from the capacitance portion flows into the clearance side, resistance of the clearance can be assuredly returned to the original value before the capacitive discharge. As a result, a situation where the inductive discharge is generated due to the current from the voltage application portion or from the capacitance portion flowing into the clearance can be assuredly prevented, whereby improvement in ignitability is assuredly achievable.

According to the ignition apparatus of Configuration 3, since the capacitance of the capacitance portion is 20 pF or more, generation of the inductive discharge can be assuredly prevented, whereby further improvement in ignitability is achievable.

On the other hand, when the capacitance of the capacitance portion is made excessively large, it takes a long time to charge the capacitance portion, and the capacitive discharge is generated at longer intervals. As a result, sufficient blowout power cannot be imparted.

According to the ignition apparatus of Configuration 3, since the capacitance of the capacitance portion is 500 pF or less, the capacitive discharge can be generated at short intervals, whereby the blowout power can be continuously imparted to plasma or an initial flame kernel. As a result, further improvement in ignitability is achievable.

According to the ignition system of Configuration 4, the same action and effect as Configuration 1 can be obtained.

According to the ignition system of Configuration 5, since the electric power energy supplied from the power supply portion is reduced to 100 mJ or less, the sufficient blowout power cannot be imparted only by the electric power energy. However, by adopting Configuration 1, sufficient blowout power can be generated even though the electric power energy is reduced. That is, Configuration 1 is particularly advantageous for improving energy efficiency when the electric power energy supplied from the power supply portion is 100 mJ or less.

DETAILED DESCRIPTION OF THE INVENTION

Figure 1:
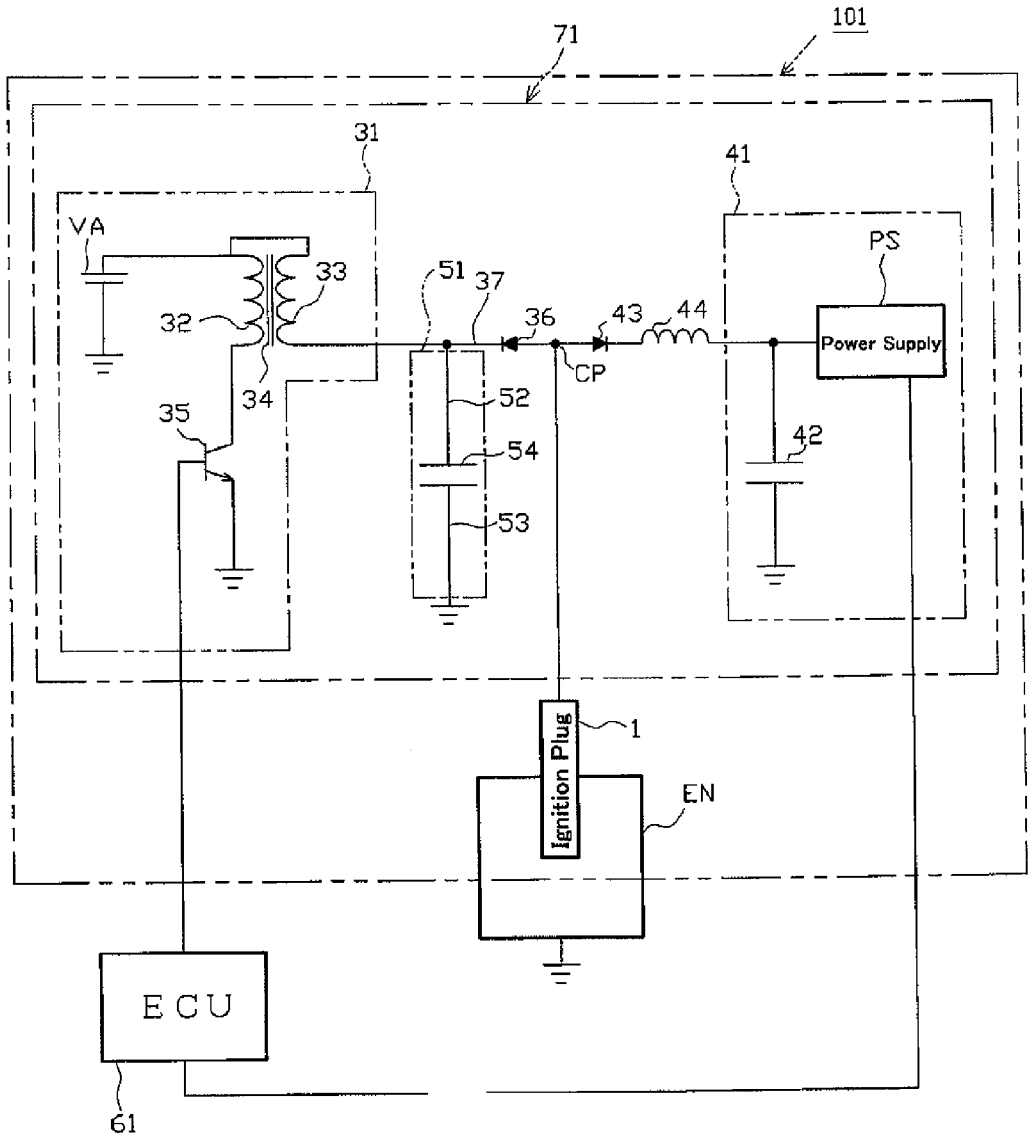
FIG. 1 is a block diagram schematically showing the configuration of an ignition system.

An embodiment of the present invention will next be described with reference to the drawings. FIG. 1 is a block diagram schematically showing a configuration of an ignition system 101 which includes a plasma jet ignition plug (hereinafter, referred to as the "ignition plug") 1 and an ignition apparatus 71 having a voltage application portion 31 and power supply portion 41. Although the single ignition plug 1 is shown in FIG. 1, a plurality of cylinders is provided in an internal combustion engine EN. The ignition plug 1 is provided in response to each cylinder. The voltage application portion 31 and the power supply portion 41 are provided for every single ignition plug 1.

First, the structure of the ignition plug 1 will be described briefly before description of the ignition system 101.

Figure 2:
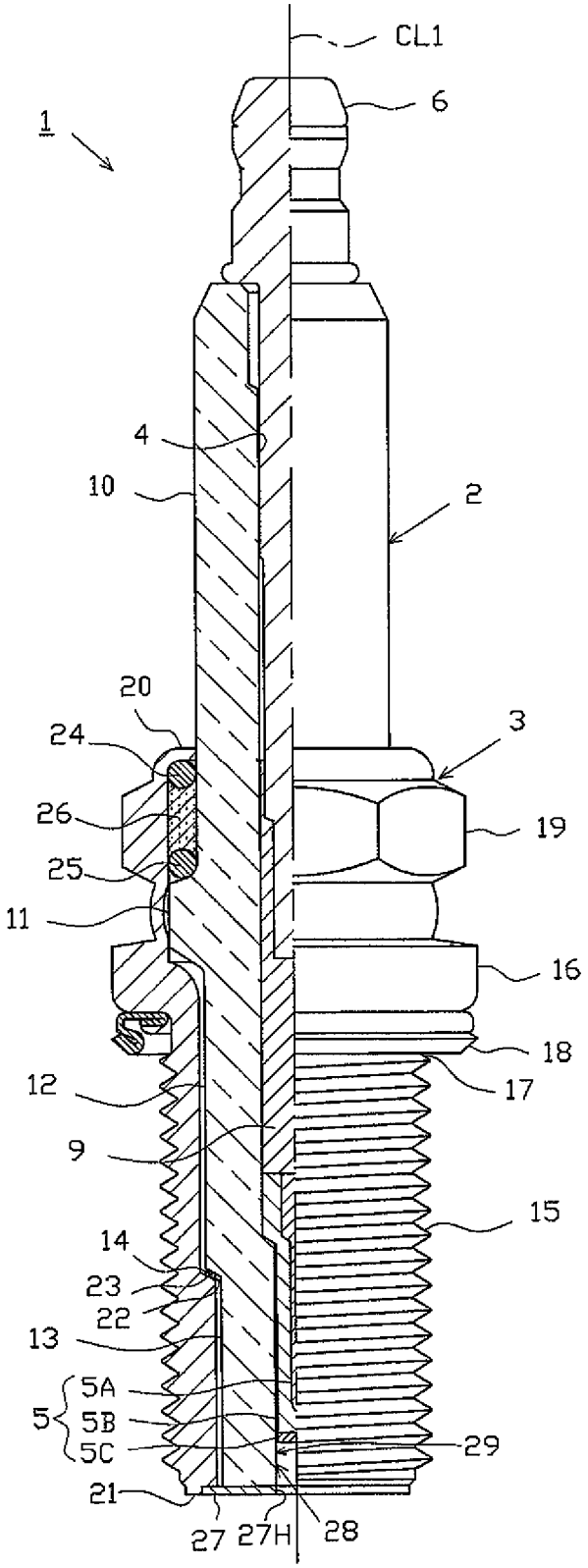
FIG. 2 is a partially cutaway front view showing the configuration of an ignition plug.

FIG. 2 is a partially cutaway front view showing the ignition plug 1. In FIG. 2, the direction of an axis CL1 of the ignition plug 1 is referred to as the vertical direction. In the following description, the lower side of the spark plug 1 in FIG. 2 is referred to as the front side of the spark plug 1, and the upper side as the rear side.

The ignition plug 1 includes a cylindrical insulator 2 and a cylindrical metallic shell 3, which holds the insulator 2 therein.

The insulator 2 is formed from alumina or the like by firing, as well known in the art. The insulator 2, as viewed externally, includes a rear trunk portion 10 formed on the rear side; a large-diameter portion 11, which is located frontward of the rear trunk portion 10 and projects radially outward; an intermediate trunk portion 12, which is located frontward of the large-diameter portion 11 and is smaller in diameter than the large-diameter portion 11; and a leg portion 13, which is located frontward of the intermediate trunk portion 12 and is smaller in diameter than the intermediate trunk portion 12. Additionally, the large-diameter portion 11, the intermediate trunk portion 12 and the leg portion 13 of the insulator 2 are accommodated within the metallic shell 3. A tapered, stepped portion 14 is formed at a connection portion between the intermediate trunk portion 12 and the leg portion 13. The insulator 2 is seated on the metallic shell 3 at the stepped portion 14.

Further, the insulator 2 has an axial bore 4 extending therethrough in the axis CL1. A center electrode 5 is fixedly inserted into a front end portion of the axial bore 4. The center electrode 5 includes an inner layer 5A made of, for example, copper or a copper alloy, which has excellent thermal conductivity, and an outer layer 5B made of a nickel (Ni) alloy (e.g. INCONEL (trademark) 600 or 601) which contains nickel as a main component. Further, the center electrode 5 assumes a rod-like (circular columnar) shape as a whole. The front end surface of the center electrode 5 is located rearward of the front end surface of the insulator 2. Notably, an electrode tip 5C formed of tungsten (W), iridium (Ir), platinum (Pt), nickel (Ni), or an alloy containing at least one kind of these metals as a primary component is provided in a region of the center electrode 5 at least up to 0.3 mm from the front end thereof to the rear end side in the axis CL1 direction.

Also, a terminal electrode 6 is fixedly inserted into a rear end side of the axial bore 4 and projects from the rear end of the insulator 2.

A circular columnar glass seal layer 9 is disposed between the center electrode 5 and the terminal electrode 6. The glass seal layer 9 electrically connects the center electrode 5 and the terminal electrode 6 together, and fixes the center electrode 5 and the terminal electrode 6 to the insulator 2.

Additionally, the metallic shell 3 is formed into a cylindrical shape from low-carbon steel or a like metal. The metallic shell 3 has, on its outer circumferential surface, a threaded portion (externally threaded portion) 15 adapted to mount the ignition plug 1 into a mounting hole of a combustion apparatus (e.g., an internal combustion engine or a fuel cell reformer). Also, the metallic shell 3 has, on its outer circumferential surface, a seat portion 16 located rearward of the threaded portion 15. A ring-like gasket 18 is fitted to a screw neck 17 at the rear end of the threaded portion 15. Further, the metallic shell 3 has, near the rear end thereof, a tool engagement portion 19 having a hexagonal cross section and allowing a tool, such as a wrench, to be engaged therewith when the metallic shell 3 is to be mounted to the combustion apparatus. Also, the metallic shell 3 has a crimp portion 20 provided at a rear end portion thereof for retaining the insulator 2. Further, the metallic shell 3 has an annular engagement portion 21 formed externally at a front end portion thereof and projecting frontward with respect to the direction of the axis CL1. A ground electrode 27, which will be described later, is joined to the engagement portion 21.

Also, the metallic shell 3 has, on its inner circumferential surface, a tapered, stepped portion 22 adapted to allow the insulator 2 to be seated thereon. The insulator 2 is inserted frontward into the metallic shell 3 from the rear end of the metallic shell 3. In a state in which the stepped portion 14 of the insulator 2 butts against the stepped portion 22 of the metallic shell 3, a rear-end opening portion of the metallic shell 3 is crimped radially inward; i.e., the crimp portion 20 is formed, whereby the insulator 2 is fixed in place. An annular sheet packing 23 intervenes between the stepped portions 14 and 22 of the insulator 2 and the metallic shell 3, respectively. This retains gastightness of a combustion chamber and prevents outward leakage of fuel gas through a clearance between the leg portion 13 of the insulator 2 and the inner circumferential surface of the metallic shell 3.

Further, in order to ensure gastightness which is established by crimping, annular ring members 24 and 25 intervene between the metallic shell 3 and the insulator 2 in a region near the rear end of the metallic shell 3, and a space between the ring members 24 and 25 is filled with a powder of talc 26. That is, the metallic shell 3 holds the insulator 2 via the sheet packing 23, the ring members 24 and 25, and the talc 26.

The ground electrode 27 assuming the form of a disk and is joined to a front end portion of the metallic shell 3 so as to be positioned in the front end side in the axis CL1 direction with respect to the front end of the insulator 2. While the ground electrode 27 is engaged with the engagement portion 21 of the metallic shell 3, an outer circumferential portion of the ground electrode 27 is welded to the engagement portion 21. In this embodiment, the ground electrode 27 is made of W, Ir, Pt, Ni or an alloy containing at least one kind of these metals as a primary component.

In addition, the ground electrode 27 has a through hole 27H which extends through a central portion thereof in the thickness direction. The inner circumference surface of the axial bore 4 and the front end face of the center electrode 5 define a cavity 28. The cavity 28 communicates with an ambient atmosphere via the through hole 27H.

In the ignition plug 1, high voltage is applied to a clearance 29 formed between the center electrode 5 and the ground electrode 27 to cause spark discharge in the clearance 29. In this condition, electric power is supplied to the clearance 29 for causing a transition of discharge state, thereby generating plasma within the cavity 28. Next, there will be described the configuration of the voltage application portion 31 for applying high voltage to the clearance 29 of the ignition plug 1 and the power supply portion 41 for supplying electric power to the clearance 29.

As shown in FIG. 1, the voltage application portion 31 is electrically connected to the ignition plug 1 via a diode 36 for preventing the inflow of the current to the voltage application portion 31 from the power supply portion 41. The voltage application portion 31 includes a primary coil 32, a secondary coil 33, a core 34 and an igniter 35.

One end of the primary coil 32, which is wound around the core 34, is connected to a power supply battery VA, and the other end thereof is connected to the igniter 35. One end of the secondary coil 33, which is also wound around the core 34, is connected to a line between the primary coil 32 and the battery VA, and the other end thereof is connected to the terminal electrode 6 of the ignition plug 1.

In addition, the igniter 35 is composed of a transistor, and permits and stops the supply of electric power from the battery VA to the primary coil 32 in accordance with an energization signal input from an ECU 61. When a high voltage is applied to the ignition plug 1, current is caused to flow from the battery VA to the primary coil 32, whereby a magnetic field is formed around the core 34. In this state, the supply of the current from the battery VA to the primary coil 32 is stopped by the ECU 61 which changes the level of the energization signal from an ON level to an OFF level. The stoppage of the current results in a change in the magnetic field around the core 34. Thus, the secondary coil 33 generates a negative high voltage (e.g., 5 kV to 30 kV). As a result of application of this negative high voltage to the ignition plug 1 (the terminal electrode 6), spark discharge can be generated in the clearance 29.

Further, in this embodiment, supply energy E (J) from the voltage application portion 31 to the clearance 29 satisfies the following relationship:

$$Ex0.05<=0.5\times C\times V^2<=Ex0.8,$$

$$(Ex0.05<=0.5\times C\times V^2<=Ex0.3 \text{ in this embodiment}),$$

where "V" (V) represents dielectric breakdown voltage in the clearance 29 (voltage required to cause spark discharge in the clearance 29), where "C" (F) represents the total capacitance of the capacitance portion 51 and the ignition plug 1, which will be described later. That is, the electric power energy ($0.5\times C\times V^2$) stored in the capacitance portion 51 and in the ignition plug 1 is set to be 0.8 times or less (0.3 times or less in this embodiment) of the supply energy E from the voltage application portion 31. By setting the electric power energy stored in the capacitance portion 51 to be 0.8 time or less of the supply energy E, the spark discharge (capacitive discharge) can be more assuredly generated in the clearance 29.

In addition, the power supply portion 41 is electrically connected to the ignition plug 1 and includes a power supply PS and a capacitor 42.

The power supply PS is a power supply circuit which can generate a negative high voltage (e.g., 500 V-1000 V), and is electrically connected to the ignition plug 1 and the capacitor 42. The ECU 61 controls a charge of the capacitor 42 from the power supply PS.

In addition, one end of the capacitor 42 is grounded and the other end thereof is connected to the power supply PS. When spark discharge is generated in the clearance 29 and the dielectric breakdown between the two electrodes 5, 27 is caused, the electric power energy stored in the capacitor 42 is supplied to the ignition plug 1, whereby plasma is generated.

In this embodiment, energy of the electric power supplied to the ignition plug 1 from the power supply portion 41 is 100 mJ or less which is relatively a small value. On the other hand, energy of the electric power is set to be 5 mJ or more so that plasma can be assuredly generated.

A diode 43 for preventing current inflow from the voltage application portion 31 to the power supply portion 41 and an inductor 44 located at the power supply portion 41 side with respect to the diode 43 are provided in the power supply path between the power supply portion 41 and the ignition plug 1.

Further, in this embodiment, a capacitance portion 51 for storing a capacitance is provided, in parallel with the ignition plug 1, in a voltage application path 37 of the voltage application portion 31. The voltage application path 37 is a portion whose voltage can be equal to the output voltage from the voltage application portion 31 due to an addition of the output voltage from the voltage application portion 31. More particularly, the voltage application path 37 is formed by a conduction path connecting the voltage application portion 31 to the ignition plug 1 and a path between a connection point CP with the conduction path and the diode 43 in a path from the power supply portion 41 to the ignition plug 1. In this embodiment, the capacitance portion 51 is connected to the upstream side (the voltage application portion 31 side) with respect to the diode 36 in the conduction path connecting the voltage application portion 31 to the ignition plug 1.

The electric power supplied from the voltage application portion 31 (the secondary coil 33) is charged in the capacitance portion 51, and the charged electric power is supplied to the clearance 29 of the ignition plug 1. The capacitance portion 51 includes conducting codes 52, 53 and a capacitor 54.

The conducting codes 52 and 53 are formed such that a lead (not shown) made of conductive metal is covered with an insulating coating (not shown) made of insulating material. One end of the conducting code 52 is connected to a line between the ignition plug 1 and the secondary coil 33, and the other end thereof is connected to the capacitor 54. One end of the conducting code 53 is connected to the capacitor 54 and the other end thereof is grounded. Each conducting code 52 and 53 has minute capacitance.

The capacitor 54 is arranged between the conducting codes 52 and 53 and has a predetermined capacitance in this embodiment. In this embodiment, the capacitance of the capacitance portion 51 (sum of the capacitance of the conducting codes 52 and 53 and the capacitance of the capacitor 54) is equal to or larger than that of the ignition plug 1. More particularly, the capacitance of the capacitance portion 51 falls within a range of 20 pF to 500 pF. The capacitance of the ignition plug 1 can be modified by arranging a facing area and a distance between the center electrode 5 and the metallic shell 3, and a material of the insulation insulator 2 (specific inductive capacity of the insulator 2).

The capacitor 54 may be configured such that the capacitance thereof is variable. In this case, the capacitance of the capacitor 54 may be controllable by the ECU 61 or other control devices. More particularly, the capacitor 54 may have a fluctuate capacitance corresponding to an increase and decrease in the dielectric breakdown voltage of the clearance 29 (e.g., the capacitance of capacitor 54 decreases when dielectric breakdown voltage increases). The dielectric breakdown voltage varies according to the factors, such as an operating condition of the internal-combustion engine EN and a volume of the clearance 29. For example, when the center electrode 5 is eroded and the volume of the clearance 29 increases, the dielectric breakdown voltage increases.

Figure 3:
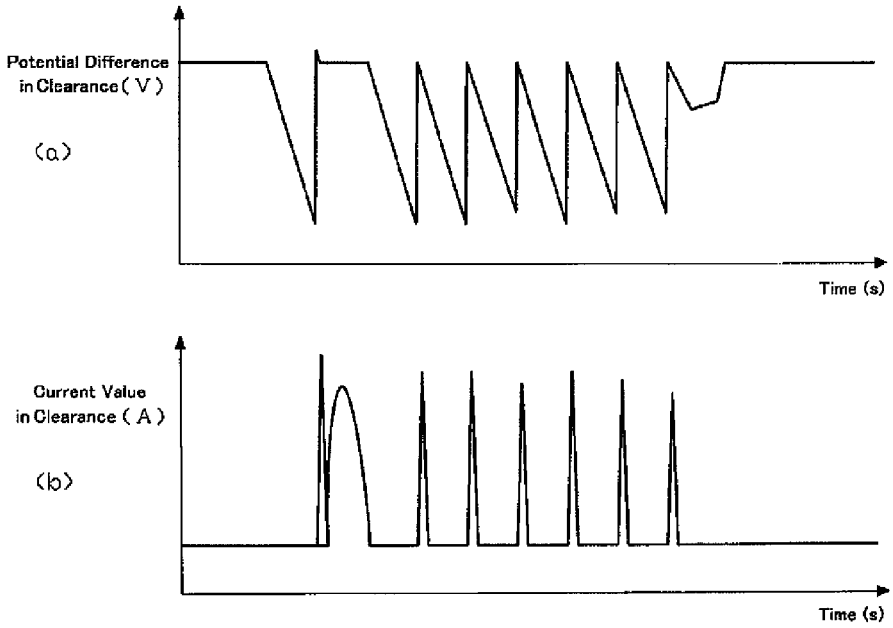
FIG. 3 illustrates (a) Waveform chart showing a potential difference in a cavity; and (b) Waveform chart showing current in the cavity.

Subsequently, the operation of the ignition system 101 will be described. First, before generating spark discharge in the clearance 29, the capacitor 42 in the power supply portion 41 is charged by the power supply PS. Then, an energization signal from the ECU 61 to the igniter 35 is set to be OFF at predetermined ignition timing so that the negative high voltage is generated in the secondary coil 33 of the voltage application portion 31. Thus, electric power energy is supplied from the voltage application portion 31 to the clearance 29 (electric power energy is continuously supplied for a predetermined period of time). Thereby, as shown in FIG. 3 (*a*), the electric charge is stored in the ignition plug 1 and the capacitance portion 51, and the potential difference of the clearance 29 increases. If the potential difference of the clearance 29 exceeds the dielectric breakdown voltage of the clearance 29, the electric charge charged in the ignition plug 1 flows into the clearance 29, and a little later, the electric charge stored in the capacitance portion 51 and the electric charge (electric power energy from the power supply portion 41) stored in the capacitor 42 also flow into the clearance 29. As a result, as shown in FIG. 3 (*b*), capacitive discharge is caused in the clearance 29 while a high current flows into the clearance 29, whereby plasma is generated. Since the electrical energy supplied from the power supply portion 41 is relatively small as 100 mJ or less, this energy is used mainly for plasma generation (i.e., the energy from the power supply portion 41 hardly generates the blowout power for plasma or the like).

When the capacitive discharge is caused, resistance of the clearance 29 becomes very small, whereby current tends to flow into the clearance 29 from the voltage application portion 31. However, since the capacitance portion 51 is provided in parallel with the ignition plug 1, the current from the voltage application portion 31 flows into the capacitance portion 51 and is charged in the capacitance portion 51. The electric charge supplied from the voltage application portion 31 after the capacitive discharge flows into not only the capacitance portion 51 but also the ignition plug 1 and the clearance 29. Since the capacitance of the capacitance portion 51 is larger than that of the ignition plug 1, the electric charge flowing into the clearance 29 decreases in volume. As a result, a discharge path cannot be maintained, and the resistance of the clearance 29 increases, thereby returning to an initial state. The supply energy from the voltage application portion 31 is only used for charging the capacitance portion 51 and the ignition plug 1. Therefore, upon completion of charging the capacitance portion 51, the resistance of the clearance 29 increases to the same extent as the resistance before the capacitive discharge. Thus, inductive discharge caused by the current from the voltage application portion 31 and the capacitance portion 51 is prevented. As a result, only the capacitive discharge is caused.

During the supply of the electric power energy from the voltage application portion 31, charging of the ignition plug 1 and the capacitance portion 51 by the electric power energy continuously supplied from the voltage application portion 31 and the capacitance portion 51, and the capacitive discharge caused by the electric charge stored in capacitance portion 51 or the like are performed repeatedly. That is, as shown in FIGS. 3 (*a*) and (*b*), the capacitive discharge is intermittently generated. This capacitive discharge generates the blowout power for the generated plasma or the initial flame to jet out towards the center of the combustion chamber in plural times. As a result, plasma or the initial flame kernel sufficiently jets out from the cavity 28.

As described above, according to this embodiment, the capacitance portion 51 is provided, in parallel with ignition plug 1, in the voltage application path 37 of the voltage application portion 31. Thus, when voltage is applied to the clearance 29 from the voltage application portion 31, electric charge is stored in both ignition plug 1 and capacitance portion 51. When the potential difference of the clearance 29 exceeds the dielectric breakdown voltage of the clearance 29, the electric charge stored in the capacitance portion 51 flows into the clearance 29 in addition to electric charge stored in the ignition plug 1, thereby causing the capacitive discharge. Therefore, the current caused by the capacitive discharge can be increased, which leads to an improvement in plasma generation efficiency.

According to the present embodiment, the current from the voltage application portion 31 flows into the capacitance portion 51 and is charged therein. That is, the capacitance portion 51 is charged by the energy conventionally used for inductive discharge. The capacitive discharge can be again generated by the electric charge stored in the capacitance portion 51 and the electric charge stored in the ignition plug 1. This effect of capacitive discharge (i.e., very quick voltage change) generates a blowout power for plasma or an initial flame kernel. During the supply of electric power energy from the voltage application portion 31, the capacitance portion 51 is charged, and the capacitive discharge can be repeatedly generated by the electric charge stored in the capacitance portion 51 or the like. Thus, the blowout power is imparted to plasma or the initial flame kernel in plural times. As a result, the large blowout power is imparted to plasma or the like, whereby excellent ignitability can be realized.

In addition, it is not necessary to supply excessive electric power energy from the power supply portion 41 to the ignition plug 1 in order to generate blowout power. The electric power energy supplied from the power supply portion 41 can be the minimum energy enough to generate plasma. Therefore, the electric power energy supplied from the power supply portion 41 can be substantially reduced to 100 mJ or less, whereby energy efficiency can be greatly improved.

Since the capacitance of the capacitance portion 51 is larger than that of the ignition plug 1, the electric charge which flows into the clearance 29 after the capacitive discharge can be reduced, and the capacitive discharge can easily cease. Therefore, when the charge of the capacitance portion 51 is completed and the current from the voltage application portion 31 or from the capacitance portion 51 flows into the clearance 29 side, resistance of the clearance 29 can be assuredly returned to the original value before the capacitive discharge. As a result, a situation where the inductive discharge is generated due to the current from the voltage application portion 31 or from the capacitance portion 51 flowing into the clearance 29 can be assuredly prevented, whereby improvement in ignitability is assuredly achievable.

Since the capacitance of the capacitance portion 51 is 20 pF or more, generation of the inductive discharge can be assuredly prevented. Further, since the capacitance of the capacitance portion 51 is 500 pF or less, the capacitive discharge can be generated at short intervals, whereby the blowout power can be continuously imparted to plasma or an initial flame kernel. As a result, further improvement in ignitability is achievable.

In addition, electric power energy ($0.5 \times C \times V^2$) stored in the capacitance portion 51 and the ignition plug 1 falls within a range of 0.05 to 0.3 times the supply energy E of the voltage application portion 31. Therefore, the capacitive discharge can be assuredly generated multiple times (about 3 to 20 times) in each supply of energy from the voltage application portion 31. As a result, further improvement in ignitability is achievable.

Figure 4:
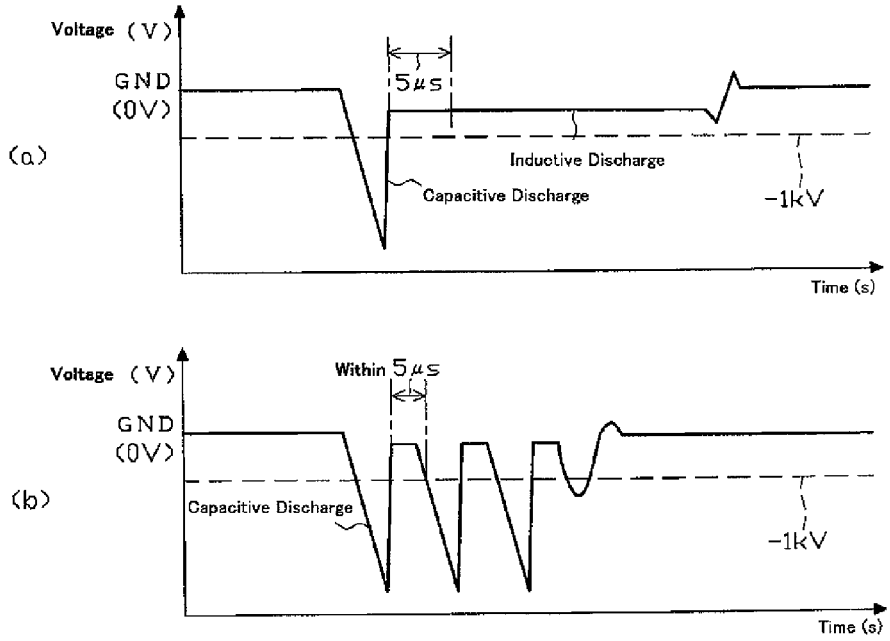
FIG. 4 illustrates (a) Waveform chart showing an example of electric discharge waveform when an inductive discharge is generated; and (b) Waveform chart showing an example of electric discharge waveform when no inductive discharge is generated.
Figure 5:
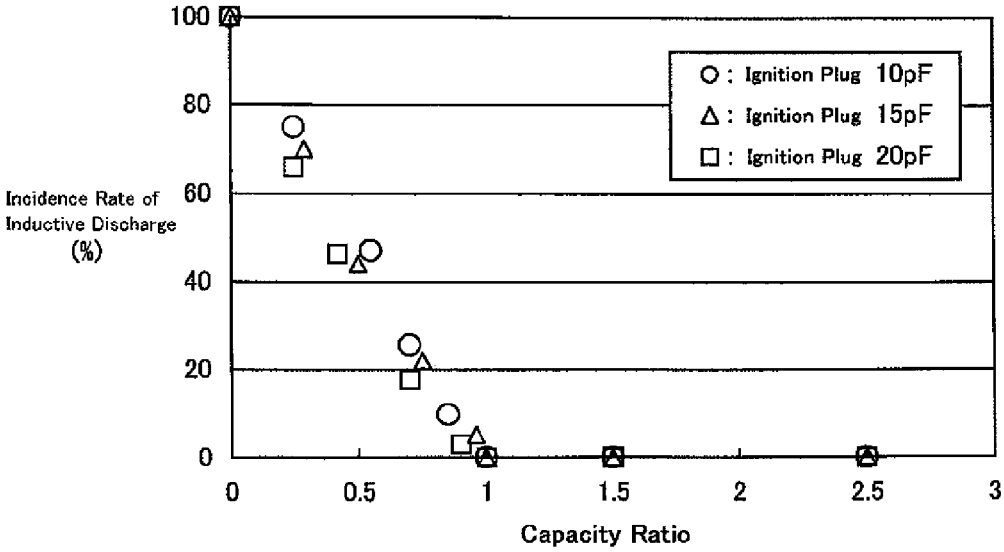
FIG. 5 is a graph showing a relationship between a capacity ratio and an incidence rate of inductive discharge.

Next, in order to verify actions and effects to be yielded by the above embodiment, there were manufactured a plurality of ignition apparatus samples which had the ignition plug differed in capacitance of 10 pF, 15 pF or 20 pF and had the capacitance portion differed in capacitance. The samples were subjected to an inductive discharge measurement test. The inductive discharge measurement test will be briefly described below. That is, spark discharge was caused 100 times in the clearance while measuring the voltage of clearance in the ignition plug. As shown in FIG. 4 (*a*), for example, when the voltage of clearance was not less than −1 kV for 5 microseconds from a dielectric breakdown, it was determined that the inductive discharge was generated following the capacitive discharge. As shown in FIG. 4 (*b*), when the voltage of clearance was less than −1 kV for 5 microseconds after the dielectric breakdown, it was determined that the inductive discharge was not generated. Then, the rate of inductive discharge (incidence rate of the inductive discharge) caused in 100 spark discharges was calculated. FIG. 5 is a graph showing a relationship between a rate of capacitance of the capacitance portion (a capacity ratio) and the incidence rate of the inductive discharge. In FIG. 5, the test result of the samples having the ignition plug with the capacitance of 10 pF is plotted with a circle. The test result of the samples having the ignition plug with the capacitance of 15 pF is plotted with a triangle. The test result of the samples having the ignition plug with the capacitance of 20 pF is plotted with a square.

The capacity ratio of 0 means that no capacitance portion was provided. Further, each sample did not have the power supply portion so as to eliminate any influence of the electric power energy from the power supply portion. Furthermore, CDI was used as a voltage application portion, and a variable capacitor was used as a capacitor of the capacitance portion. In addition, the capacitance of the ignition plug was modified by arranging a material of the insulator or a facing area between the metallic shell and the center electrode. The capacitance of the capacitance portion was modified by adjusting the capacitance of the capacitor.

As shown in FIG. 5, the samples having the capacity ratio of 1.0 or more (i.e., the capacitance of the capacitance portion was equal to or larger than the capacitance of the ignition plug) had the inductive discharge rate of 0%. It is apparent that the supplied energy was very efficiently utilized for the capacitive discharge. This is because the following situation is prevented: since it took time to charge the capacitance portion, the capacitive discharge ceased upon completion of charging the capacitance portion, whereby the current from the voltage application portion or the like flows into the clearance following the capacitive discharge.

According to the above test, in order to improve ignitability through the supply energy from the voltage application portion efficiently utilized for generation of the capacitive discharge, the capacitance of the capacitance portion is preferably equal to or larger than the capacitance of the ignition plug.

Figure 6:
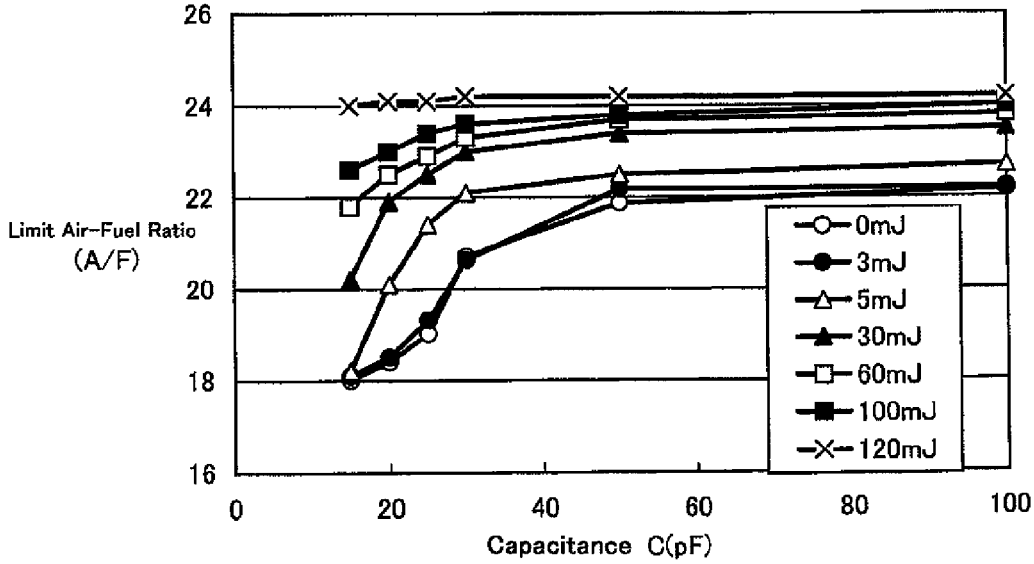
FIG. 6 is a graph showing a result of ignitability evaluation test in samples which differ in capacitance of a capacitance portion and in electric power energy from a power supply portion.
Figure 7:
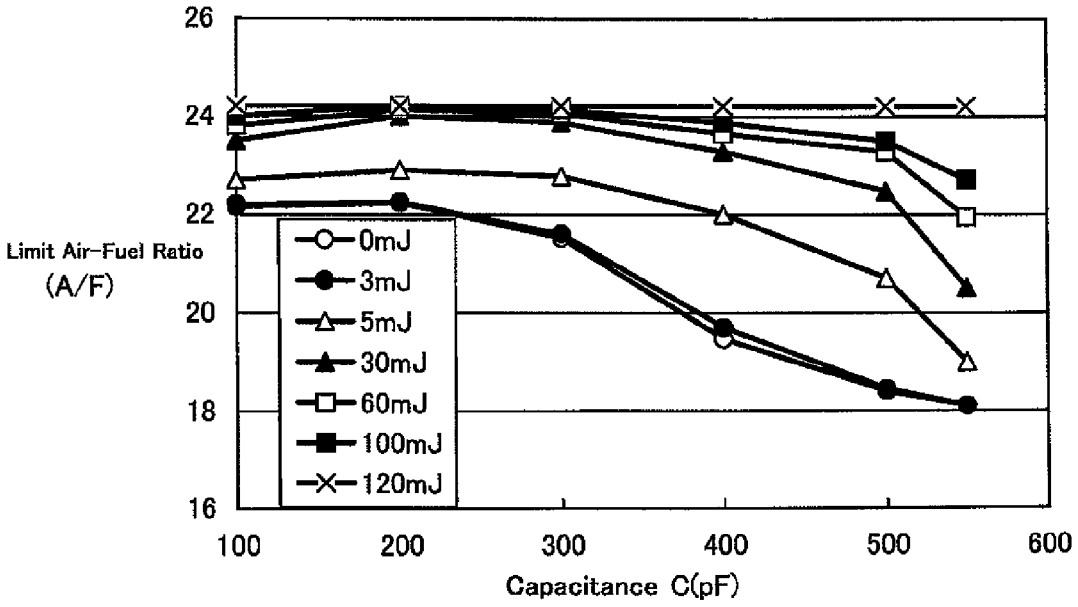
FIG. 7 is a graph showing a result of ignitability evaluation test in samples which differ in capacitance of a capacitance portion and in electric power energy from a power supply portion.

Next, there were manufactured a plurality of ignition apparatus samples which differ in the electric power energy (mJ) supplied from the power supply portion and in the capacitance C (pF) of the capacitance portion for an ignitability test. The ignitability test will be briefly described below. That is, after each sample of ignition plug was mounted on a four-cylinder engine of 2.0 L displacement. The engine was operated at a speed of 1500 rpm with ignition timing set to MIST (optimal spark position). While the air-fuel ratio was being increased (the fuel content was being reduced), the variation rate of engine torque was measured in relation to the air-fuel ratio. An air-fuel ratio at which the variation rate of engine torque exceeded 5% was obtained as a limit air-fuel ratio. The higher the limit air-fuel ratio, the better the ignition performance. FIGS. 6 and 7 show the test result. In FIGS. 6 and 7, the test result of the samples having the electric power energy of 0 mJ is plotted with a white circle. The test result of the samples having the electric power energy of 3 mJ is plotted with a black circle. The test result of the samples having the electric power energy of 5 mJ is plotted with a white triangle. The test result of the samples having the electric power energy of 30 mJ is plotted with a black triangle. The test result of the samples having the electric power energy of 60 mJ is plotted with a white square. The test result of the samples having the electric power energy of 100 mJ is plotted with a black square. The test result of the samples having the electric power energy of 120 mJ is plotted with a cross. In the test, the capacitance of the capacitance portion was equal to or larger than that of the ignition plug. In addition, electric power energy from the power supply portion of 0 mJ means that no power supply portion was provided.

As is apparent from FIGS. 6 and 7, the samples having the capacitance of the capacitance portion of 20 pF or more showed substantial increase in a limit air-fuel ratio and excellent ignitability. This is because the generation of the inductive discharge was assuredly prevented when the capacitance was 20 pF or more. When the electric power energy from the power supply portion was less than 5 mJ and the capacitance C was made relatively small, not much improvement in ignitability was demonstrated. It has been considered that there was interference with generation of plasma because the electric power energy was too small. Therefore, the electric power energy is preferably at a level such that plasma can be generated (e.g., 5 mJ or more).

The samples having the capacitance of the capacitance portion of over 500 pF showed slightly inferior ignitability. The reason for that result was thought to be that the capacitive discharge was generated at longer intervals because it took a long time to charge the capacitance portion. As a result, sufficient blowout power cannot be imparted.

Further, the samples having the electric power energy from the power supply portion of more than 100 mJ exhibited excellent ignitability regardless of the magnitude of the capacitance of the capacitance portion. This is because the electric power energy was large enough to generate sufficient blowout power. That is, when the electric power energy is more than 100 mJ, the energy of the capacitive discharge is wasted because no blowout power is generated through the capacitive discharge of the capacitance portion.

According to the results of the tests, the capacitance of the capacitance portion preferably falls within a range of 20 pF to 500 pF in order to further improve ignitability. Further, in order to more securely generate plasma and to further improve ignitability, the energy of the electric power supplied from the power supply portion is preferably 5 mJ or more.

In addition, the electric power supplied from the power supply portion is preferably 100 mJ or less in order to effectively utilize the energy of capacitive discharge from the capacitance portion thereby assuredly improving energy efficiency.

The present invention is not limited to the above-described embodiment, but may be embodied, for example, as follows. Of course, applications and modifications other than those exemplified below are also possible.

(a) Although the capacitance portion 51 is provided with the single capacitor 54 in the above embodiment, two or more capacitors connected in parallel may be included in the capacitance portion 51.

(b) Although the voltage application portion 31 and the power supply portion 41 are formed in each ignition plug in the above embodiment, it is not necessary to provide them. The electric power from the voltage application portion 31 or the power supply portion 41 may be supplied to each ignition plug 1 through a distributor.

(c) The configuration of the ignition plug 1 described in the above embodiment is an example, and it is not particularly limited to a plasma jet ignition plug. Thus, for example, an inner circumference of the ground electrode 27 which tends to be eroded by spark discharge may be made of a metal, such as W and Ir. Further, the center electrode 5 may be formed without the electrode tip 5C.

DESCRIPTION OF REFERENCE NUMERALS

1: ignition plug (plasma jet ignition plug)
5: center electrode
27: ground electrode
29: clearance
31: voltage application portion
37: voltage application path
41: power supply portion
51: capacitance portion
71: ignition apparatus
101: ignition system Having described the invention, the following is claimed:

1. An ignition apparatus used for a plasma jet ignition plug which includes a center electrode, a ground electrode, and a cavity which surrounds at least a portion of a clearance formed between the center electrode and the ground electrode to thereby form a discharge gap, the ignition apparatus comprising: a voltage application portion which applies voltage to the clearance; and a power supply portion which supplies electric power to the clearance, wherein a capacitance portion for storing a capacitance is provided, in parallel with the plasma jet ignition plug, in a voltage application path of the voltage application portion, wherein a capacitance of the capacitance portion is equal to or larger than that of the plasma jet ignition plug.

2. The ignition apparatus according to claim 1, wherein the capacitance of the capacitance portion falls within a range of 20 pF to 500 pF.

3. An ignition system, comprising: a plasma jet ignition plug including a center electrode, a ground electrode, and a cavity which surrounds at least a portion of a clearance formed between the center electrode and the ground electrode to thereby form a discharge gap; and an ignition comprising: a voltage application portion which applies voltage to the clearance; and a power supply portion which supplies electric power to the clearance, wherein electric power energy supplied from the power supply portion is 100 mJ or less, wherein a capacitance portion for storing a capacitance is provided, in parallel with the plasma jet ignition plug, in a voltage application path of the voltage application portion, and wherein the plasma jet ignition plug is electrically connected to the voltage application portion and the power supply portion.

4. The ignition apparatus according to claim 3, wherein a capacitance of the capacitance portion is equal to or larger than that of the plasma jet ignition plug.

5. The ignition apparatus according to claim 3, wherein the capacitance of the capacitance portion falls within a range of 20 pF to 500 pF.

* * * * *